US009378911B2

(12) United States Patent
Takahashi

(10) Patent No.: US 9,378,911 B2
(45) Date of Patent: Jun. 28, 2016

(54) FUSE AND FUSE ATTACHMENT STRUCTURE

(71) Applicant: YAZAKI CORPORATION, Minato-ku, Tokyo (JP)

(72) Inventor: Asako Takahashi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 339 days.

(21) Appl. No.: 13/964,146

(22) Filed: Aug. 12, 2013

(65) Prior Publication Data

US 2013/0328658 A1 Dec. 12, 2013

Related U.S. Application Data

(63) Continuation of application No. PCT/JP2011/053555, filed on Feb. 18, 2011.

(51) Int. Cl.

| | |
|---|---|
| ***H01H 85/10*** | (2006.01) |
| ***H01H 85/175*** | (2006.01) |
| ***H01H 37/76*** | (2006.01) |
| ***H01H 85/147*** | (2006.01) |

(52) U.S. Cl.

CPC ..... *H01H 37/761* (2013.01); *H01H 85/10* (2013.01); *H01H 85/147* (2013.01); *H01H 85/175* (2013.01)

(58) Field of Classification Search

CPC .... H01H 85/10; H01H 37/761; H01H 85/175
USPC ..... 337/186, 187, 198, 251
See application file for complete search history.

(56) References Cited

U.S. PATENT DOCUMENTS

| | | | | | |
|---|---|---|---|---|---|
| 2,830,156 | A | * | 4/1958 | Burgess, Jr. | H01H 85/0417 337/222 |
| 2,988,619 | A | * | 6/1961 | Rosso | H01H 85/044 337/270 |
| 3,110,787 | A | * | 11/1963 | Borzoni | H01H 85/0417 337/260 |
| 3,304,396 | A | * | 2/1967 | Hasson | H01H 37/761 337/405 |
| 3,500,462 | A | * | 3/1970 | Gregory | H01H 85/046 337/187 |
| 4,164,726 | A | * | 8/1979 | Weibe | H01H 85/0417 337/215 |
| 4,219,793 | A | | 8/1980 | Kawamura | |
| 4,365,226 | A | | 12/1982 | Barry et al. | |
| 4,532,489 | A | * | 7/1985 | Phillips | H01H 85/0411 29/623 |

(Continued)

FOREIGN PATENT DOCUMENTS

| | | | |
|---|---|---|---|
| CN | 1071532 | A | 4/1993 |
| CN | 1311517 | A | 9/2001 |

(Continued)

OTHER PUBLICATIONS

Korean office action issued on Sep. 17, 2014.

(Continued)

*Primary Examiner* — Anatoly Vortman
(74) *Attorney, Agent, or Firm* — Mots Law, PLLC

(57) ABSTRACT

A fuse includes: a conductive fuse element having a pair of connection terminals formed by bending two ends of a conductive wire rod in such a manner that the ends extend parallel with each other, and a meltable portion provided between the pair of connection terminals and formed to have a smaller cross-sectional area than the remainder of the fuse element; and an insulative shape retaining member fixed to the fuse element and retaining the shape of the fuse element.

11 Claims, 8 Drawing Sheets

(56) References Cited

U.S. PATENT DOCUMENTS

| | | | | | |
|---|---|---|---|---|---|
| 4,544,907 | A * | 10/1985 | Takano | H01H 85/0417 | 337/262 |
| 4,672,352 | A * | 6/1987 | Takano | H01H 85/0417 | 337/260 |
| 4,751,490 | A * | 6/1988 | Hatagishi | H01H 85/10 | 337/166 |
| 4,869,972 | A * | 9/1989 | Hatagishi | H01H 85/06 | 337/295 |
| 5,841,338 | A * | 11/1998 | Yasukuni | H01H 85/0411 | 337/164 |
| 5,883,561 | A * | 3/1999 | Nakamura | H01H 85/0417 | 337/159 |
| 6,407,657 | B1 * | 6/2002 | Oh | H01R 13/112 | 337/181 |
| 7,701,321 | B2 * | 4/2010 | Banzo | H01H 85/0417 | 337/186 |
| 2008/0272877 | A1 * | 11/2008 | Kwon | H01H 1/20 | 337/198 |

FOREIGN PATENT DOCUMENTS

| | | | |
|---|---|---|---|
| CN | 100593890 | C | 3/2010 |
| DE | 1413956 | B2 | 1/1975 |
| JP | S53-104929 | U | 8/1978 |
| JP | S53-107137 | | 8/1978 |
| JP | S56-25440 | U | 3/1981 |
| JP | H3-15448 | U | 2/1991 |
| JP | 2001-297684 | A | 10/2001 |
| JP | 2003-217435 | A | 7/2003 |
| JP | 2004-311289 | | 11/2004 |
| JP | 2006-333583 | A | 12/2006 |
| KR | 10-2007-0106139 | A | 11/2007 |

OTHER PUBLICATIONS

The Chinese office action letter issued on Dec. 5, 2014, in the counterpart Chinese patent application. (Application No. 201180067902.1).

The Chinese office action letter issued on Aug. 10, 2015 in the counterpart Chinese patent application.

The Office Action issued on Mar. 2, 2016 in the counterpart German patent application.

* cited by examiner

FUSE AND FUSE ATTACHMENT STRUCTURE

CROSS-REFERENCE TO RELATED APPLICATION

This application is a Continuation of PCT Application No. PCT/JP2011/053555, filed on Feb. 18, 2011, and the content of which is incorporated herein by reference.

TECHNICAL FIELD

The present invention relates to a fuse which prevents supply of an overcurrent, and to a fuse attachment structure for attaching the fuse.

BACKGROUND ART

As shown in FIGS. 1 (*a*) and (*b*), a conventional fuse 50 includes a fuse element 51 provided with a pair of connection terminals 51*a* and a meltable portion 51*b* located therebetween, and a shape retaining member 52 retaining the shape of the fuse element 51 by covering the exterior of the fuse element 51 while exposing only portions of the pair of connection terminals 51*a*. The fuse element 51 is formed by punching a flat plate of a conductive material with a press machine.

FIG. 2 shows a conventional vehicle junction box 60 to which such fuses 50 are attached (see Patent Literature 1). The vehicle junction box 60 includes: a board 61 provided with branching circuits to branch and distribute power supply from a battery or an alternator to various loads; connectors 62 and 63 fixed to the board 61 and used to establish connection to the battery and the alternator as well as connection to the various loads; and a fuse attachment unit 64 fixed to the board 61 and configured to prevent supply of an overcurrent to the loads.

The fuse attachment unit 64 includes multiple cavities 65, and a fuse 50 is attached to each cavity 65. Here, a width dimension W3 of each cavity 65 is determined by a width W4 of the fuse 50.

CITATION LIST

Patent Literature

[PTL 1] Japanese Patent Application Publication No. 2006-333583

SUMMARY OF INVENTION

Technical Problem

However, the conventional fuse 50 has a problem of producing a large amount of material loss since the fuse element 51 is formed by punching the flat plate with the press machine. Specifically, regions E in FIG. 1 (*b*) cause such material loss.

Meanwhile, in the conventional fuse 50, the flat connection terminals 51*a* each having a large area are connected to both ends of the meltable portion 51*b* having a small cross-sectional area, whereby the width of the connection terminals 51*a* is large. Accordingly, the fuse element 51, or in particular, the shape retaining member 52 which retains the shape of the pair of connection terminals 51*a* is also formed into a wide and complicated shape, whereby the dimension W4 of the fuse 50 is increased. For this reason, the cavities 65 of the fuse attachment unit 64 are increased in size, which is a factor for a size-increase in the outermost shape of the vehicle junction box 60.

The present invention has been made to solve the aforementioned problems. An object of the present invention is to provide a fuse which can be formed with little material loss and can be reduced in size, and to provide a fuse attachment structure using the fuse.

Solution to Problem

A first aspect of the invention of this application provides a fuse including: a conductive fuse element including a pair of connection terminals formed by bending two ends of a conductive wire rod, and a meltable portion provided between the pair of connection terminals and formed to have a smaller cross-sectional area than the remainder of the fuse element; and an insulative shape retaining member fixed to the fuse element and retaining a shape of the fuse element.

A second aspect of the invention of this application provides the fuse in which the meltable portion of the fuse element has a bent shape.

A third aspect of the invention of this application provides the fuse in which the shape retaining member has a lock portion designed to be locked by elastic deformation, and the shape retaining member is attachable to inside of a fuse container box by use of the lock portion.

A fourth aspect of the invention of this application provides a fuse attachment structure adapted to contain the fuse in a fuse container box including multiple cavities partitioned by partition walls.

Advantageous Effects of Invention

According to the first aspect of the present invention, the fuse element can be manufactured by cutting the conductive wire rod into a predetermined length and then bending or crushing the cut wire rod. Thus, the fuse element can be manufactured with little material loss of the conductive wire rod. In addition, since the fuse element is the wire rod, each connection terminal has a small width, and the insulative retaining member to retain the shape of the fuse element may have a small width and a simple shape. Thus, the fuse can be reduced in size.

In addition to the above-mentioned effects, according to the second aspect of the invention of this application, it is possible to form the fuse for a low current value and to further reduce the width dimension of the fuse element.

In addition to the above-mentioned effects, according to the third aspect of the invention of this application, the fuse can be attached reliably to the fuse container box so as not to drop off merely by insertion of the fuse.

According to the fourth aspect of the invention of this application, each fuse is small in size, so that each cavity can be formed small. Thus, the fuse container box can be reduced in size (reduced in height). In addition, since the fuse container box has the multiple cavities partitioned by the partition walls, the fuses thus reduced in size can be mounted densely while short circuits among the fuses are prevented.

DESCRIPTION OF EMBODIMENTS

Embodiments of the present invention will be described below with reference to the drawings.

First Embodiment

Figure 1:
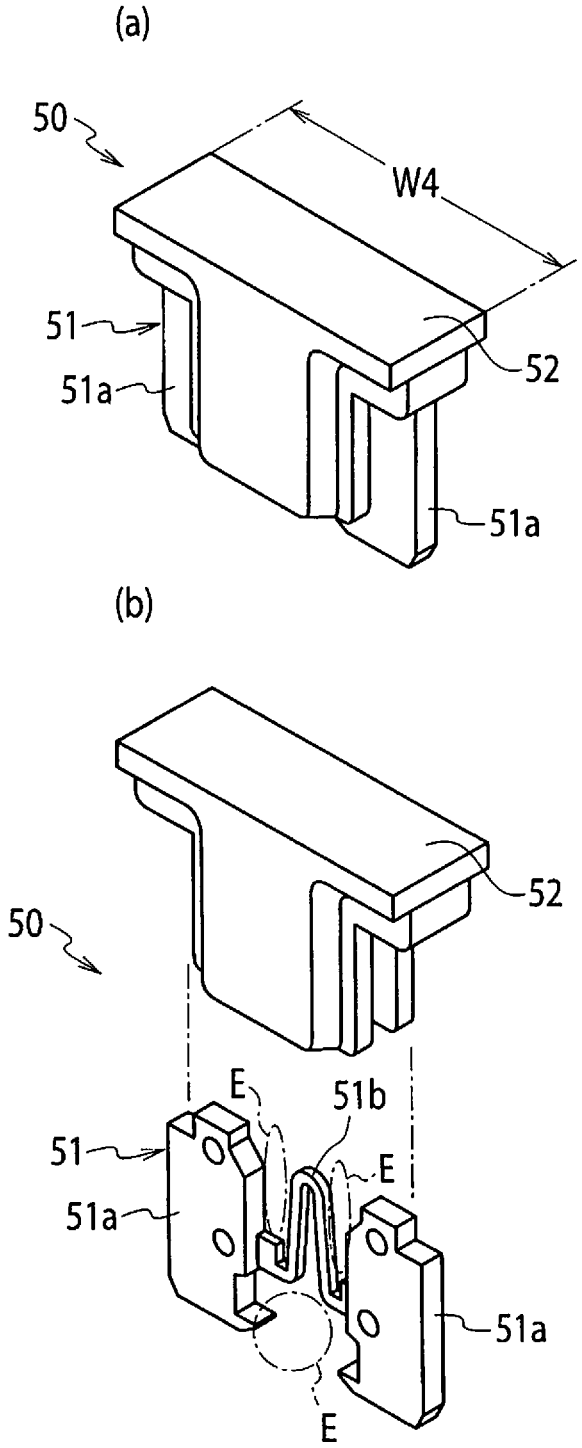
FIG. 1 PRIOR ART
FIG. 1 (*a*) is a perspective view of a fuse of a conventional example and (*b*) is an exploded perspective view of the fuse of the conventional example.
Figure 2:
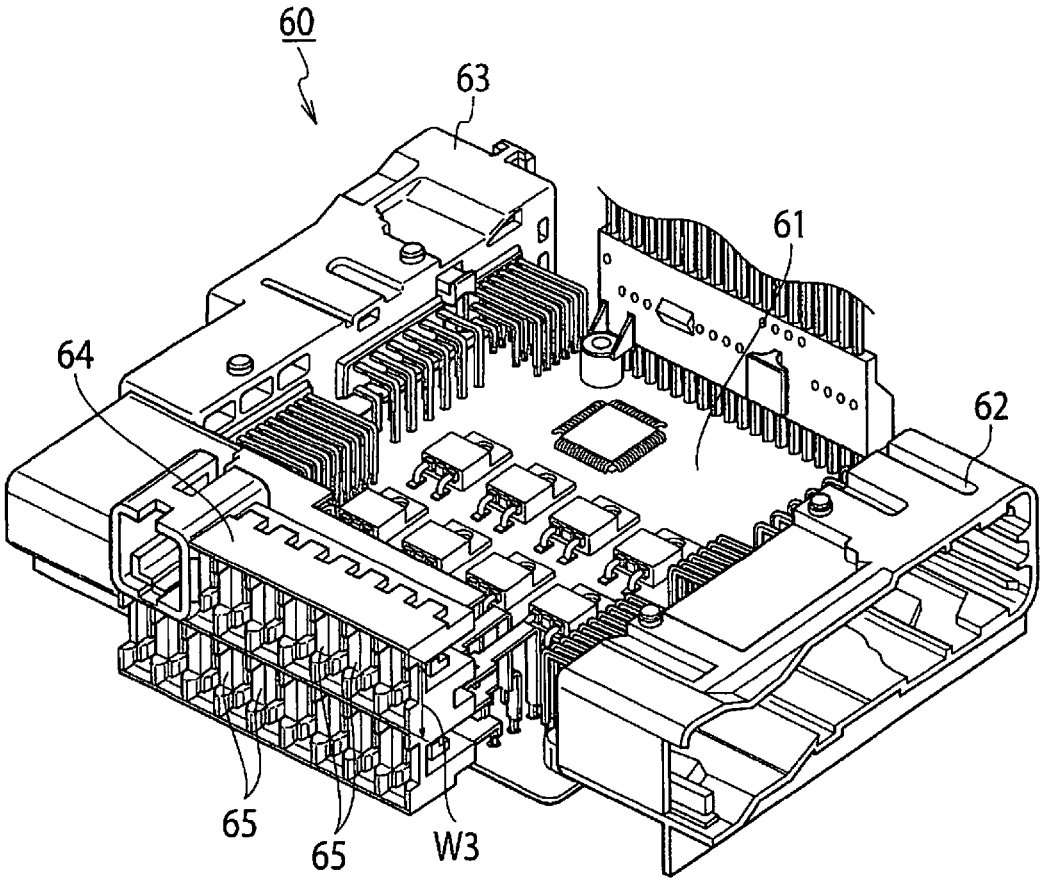
FIG. 2 PRIOR ART
FIG. 2 is a perspective view of a vehicle junction box to which the fuses of the conventional example are attached.
Figure 3:
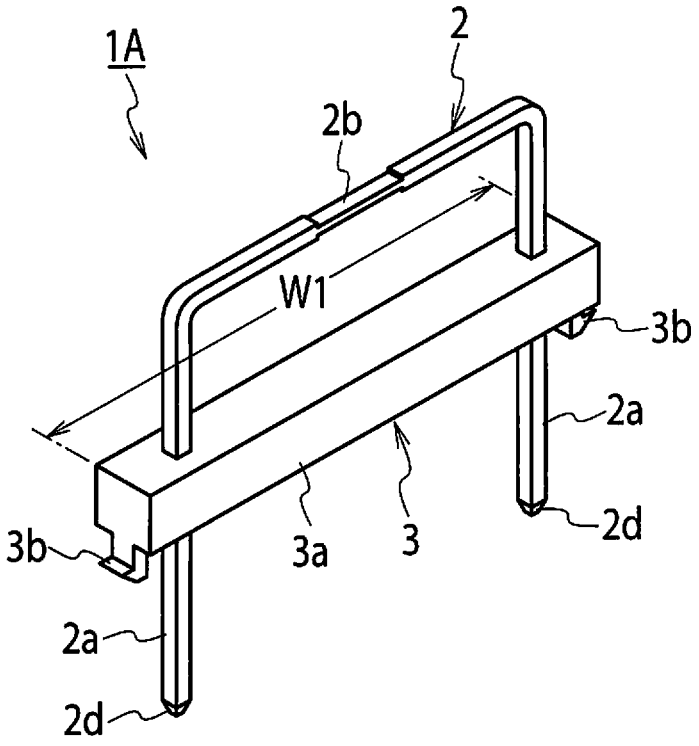
FIG. 3 is a perspective view of a fuse showing a first embodiment of the present invention.

FIG. 3 is a perspective view of a fuse showing a first embodiment of the present invention.

As shown in FIG. 3, a fuse 1A includes a fuse element 2 made of a conductive and rigid wire rod, and a shape retaining member 3 made of a synthetic resin and fixed to the fuse element 2.

Figure 4:
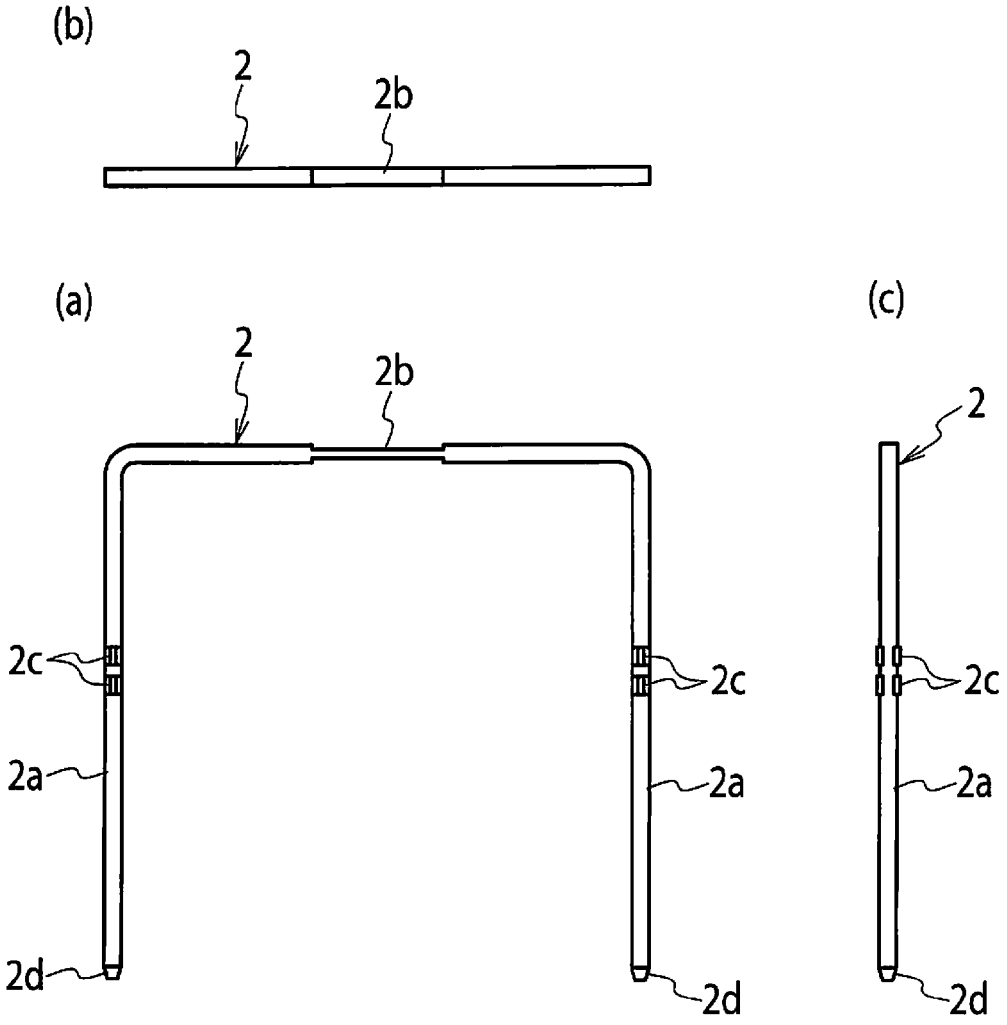
FIG. 4 shows a first embodiment of the present invention, (*a*) is a front view of a fuse element showing, (*b*) is a plan view of the fuse element, and (*c*) is a right side view of the fuse element.

As shown in FIG. 4 (*a*) to (*c*) in detail, the fuse element 2 is formed from the wire rod made of a zinc alloy, for example, and having a substantially quadrangular cross-sectional shape. The fuse element 2 is formed substantially into a U-shape and is provided with: a pair of connection terminals 2*a* formed by bending two ends of the wire rod, which is cut into a predetermined dimension, in such a manner that the ends extend parallel with each other; and a meltable portion 2*b* provided between the pair of connection terminals 2*a* and formed to have a smaller cross-sectional area than the remainder of the fuse element 2.

The meltable portion 2*b* is crushed and thereby formed to have the smaller cross-sectional area than the remainder. The cross-sectional area and length of the meltable portion 2*b* are adjusted as appropriate depending on a value of an allowable current. Press-fit lock portions 2*c* each having a tiny projection protruding from a surface thereof are formed in intermediate positions of the respective connection terminals 2*a*. A tip end portion of each connection terminal 2*a* is crushed and thereby formed into a tapered portion 2*d* that is tapered forward.

As shown in FIG. 3, the shape retaining member 3 includes a block portion 3*a* in an elongated rectangular shape having a slightly larger dimension than a width of the fuse element 2. Lock portions 3*b* project outward from two ends on a bottom surface of the block portion 3*a*. The pair of lock portions 3*b* are elastically deformed by an external force from below in such a manner that the lock portions 3*b* are held within the width dimension of the block portion 3*a*.

The shape retaining member 3 is fixed by the pair of connection terminals 2*a* of the fuse element 2 being press-fitted into the block portion 3*a* down to the positions of the press-fit lock portions 2*c*. The shape retaining member 3 fixed by press-fitting does not easily drop off with the assistance of strong locking force of the press-fit lock portions 2*c*. The shape retaining member 3 retains the shape of the fuse element 2. Accordingly, the shape of the fuse element 2 is retained so as to avoid a deformation such as expansion or contraction of a clearance between the pair of connection terminals 2*a*.

Next, description will be given of a fuse container box 10 to contain a number of the fuses 1A thus configured.

Figure 5:
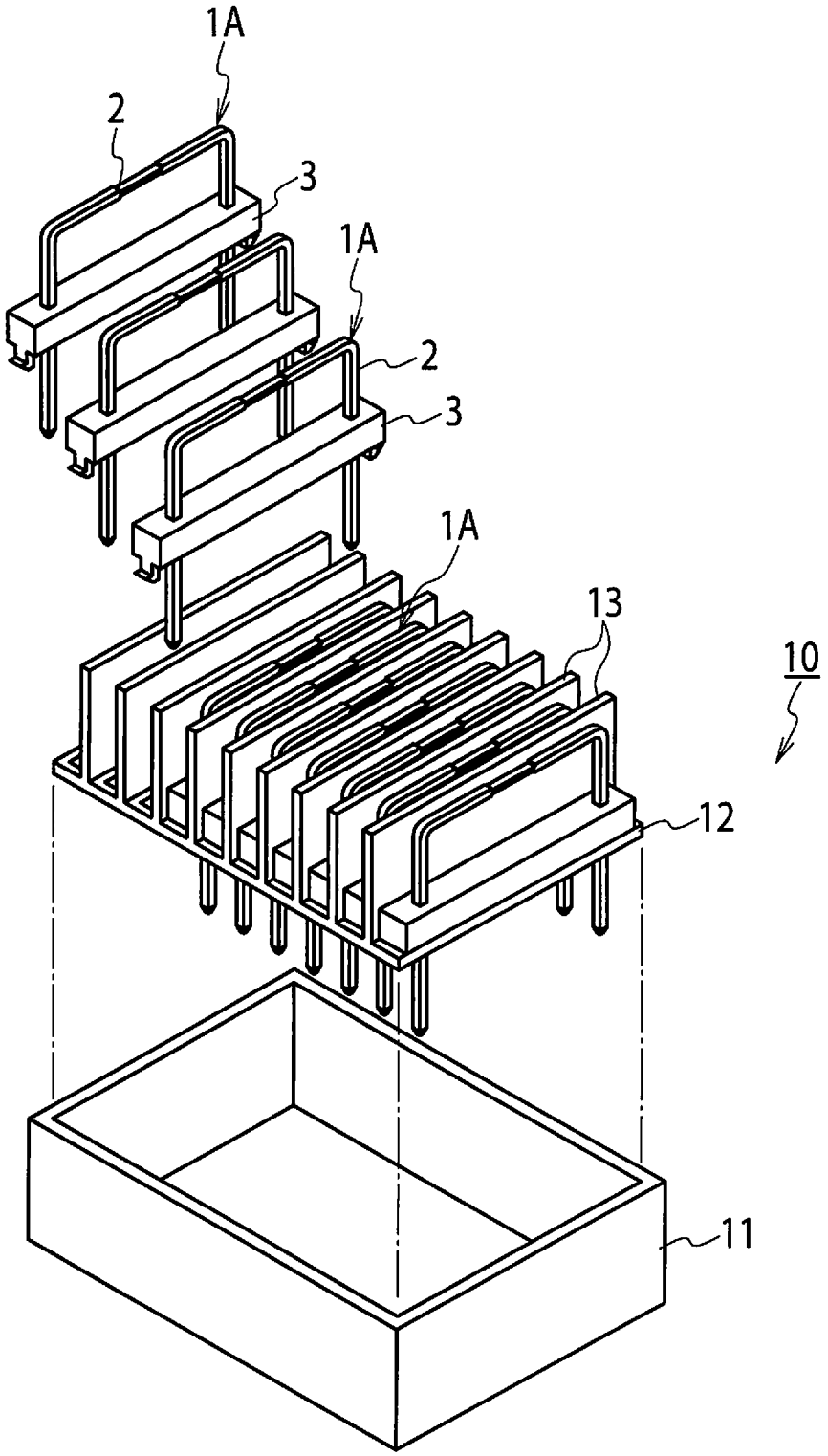
FIG. 5 is an exploded perspective view illustrating a process of attaching the fuses to a fuse container box, showing the first embodiment of the present invention.
Figure 6:
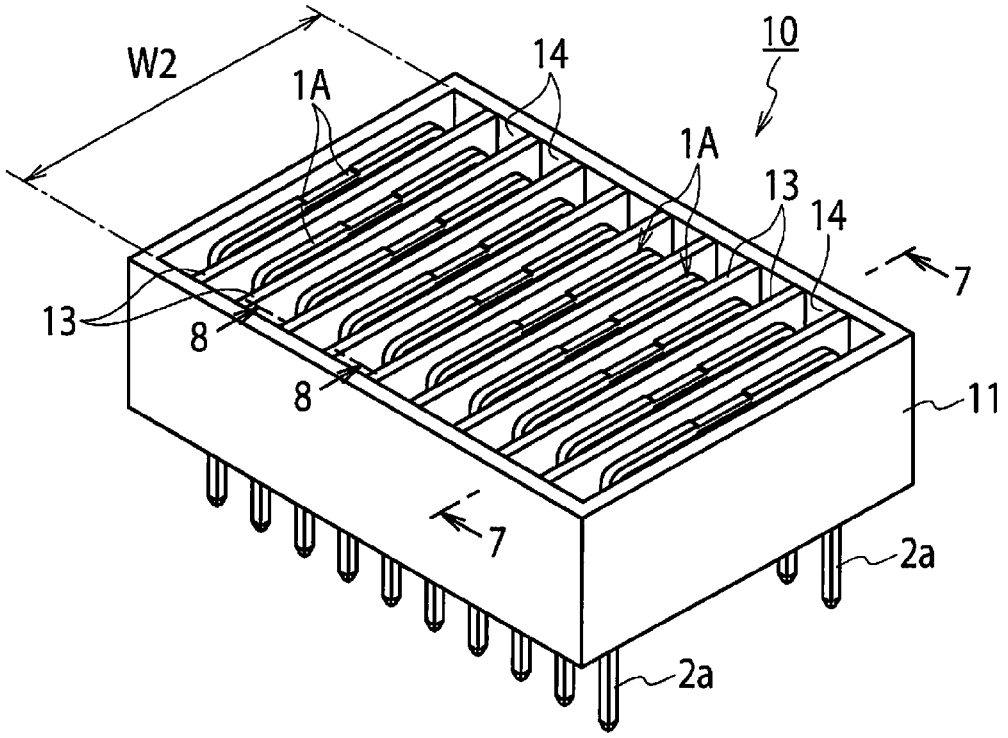
FIG. 6 is a perspective view illustrating the fuse container box containing the fuses, showing the first embodiment of the present invention.

As shown in FIG. 5 and FIG. 6, the fuse container box 10 includes a rectangular frame 11, a base plate 12 placed at a bottom face of the frame 11, and multiple partition walls 13 arranged at intervals on the base plate 12. The frame 11, the base plate 12, and the partition walls 13 are made of an insulative resin material.

Multiple (ten in this embodiment) cavities 14 partitioned by the partition walls 13 are arranged in a lateral row inside the fuse container box 10. A width dimension W2 of each cavity 14 is set slightly larger than a width W1 of the fuse 1A described above. However, since the width of the fuse 1A is narrow in the first place, the width of the cavity 14 is set sufficiently narrower than the cavity of the conventional example.

Figure 7:
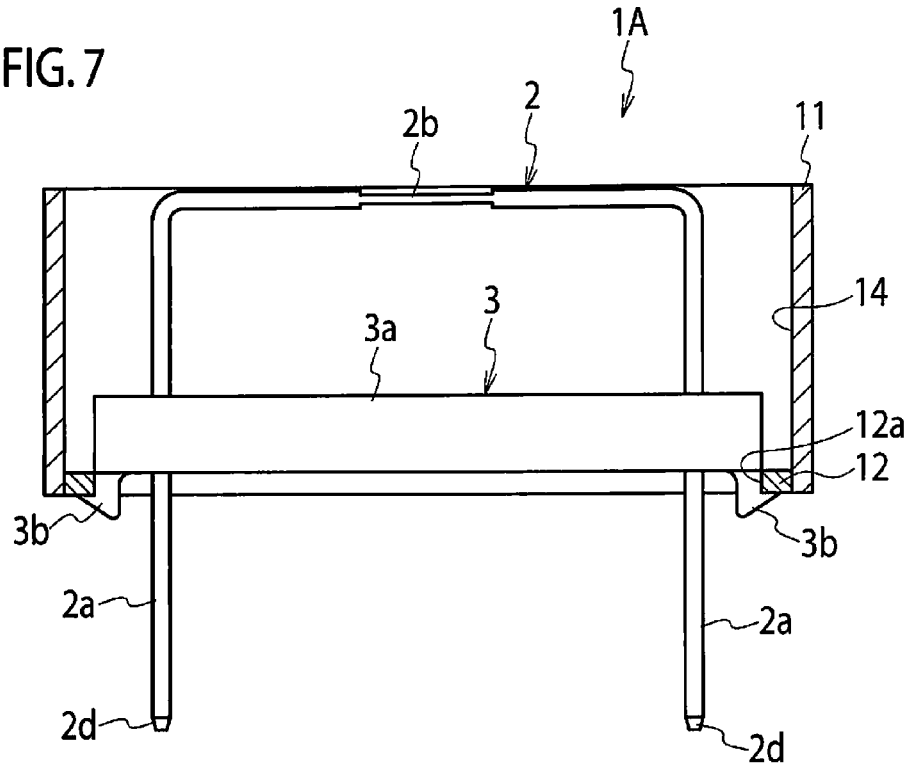
FIG. 7 is a cross-sectional view taken along the 7-7 line in FIG. 6, showing the first embodiment of the present invention.
Figure 8:
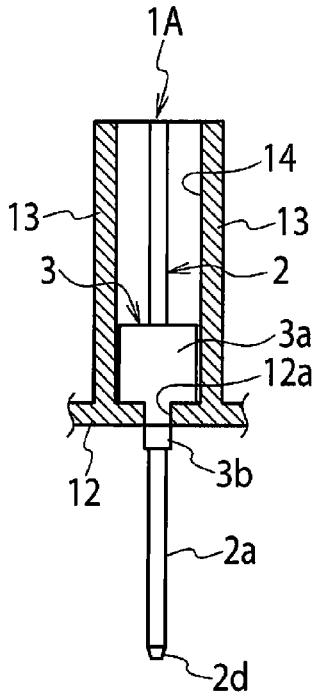
FIG. 8 is a cross-sectional view taken along the 8-8 line in FIG. 6, showing the first embodiment of the present invention.

Terminal insertion holes 12*a* (shown in FIG. 7 and FIG. 8) are formed at positions in the base plate 12 corresponding to the respective cavities 14. A width dimension of each terminal insertion hole 12*a* is set to such a width dimension as to allow insertion of the pair of connection terminals 2*a* of the fuse 1A while inhibiting insertion of the block portion 3*a*.

When the fuse 1A is inserted into the cavity 14, the pair of connection terminals 2*a* go into the terminal insertion hole 12*a* and then the lock portions 3*b* of the shape retaining member 3 hit peripheral edges of the terminal insertion hole 12*a*. When the fuse 1A is inserted further from this position, the pair of lock portions 3*b* are elastically deformed and allowed to be inserted into the terminal insertion hole 12*a*. At the same time as when the pair of lock portions 3*b* pass through the terminal insertion holes 12*a*, the block portion 3*a* of the shape retaining member 3 hits the base plate 12 and the pair of lock portions 3*b* are elastically restituted and then locked with peripheral edges, on an opposite face side, of the terminal insertion hole 12*a*. Thus, the fuse 1A is attached to the cavity 14 of the fuse container box 10 as shown in FIG. 6.

The fuse container box 10 attaching the fuses 1A thereto is attached to a fuse attachment structure of a power source holder in a vehicle junction box, for instance.

As described above, the fuse 1A includes: the conductive fuse element 2 having the pair of connection terminals 2*a* formed by bending the two ends of the conductive wire rod in such a manner that the ends extend parallel with each other, and the meltable portion 2*b* provided between the pair of connection terminals 2*a* and formed to have the smaller cross-sectional area than the remainder of the fuse element 2; and the insulative shape retaining member 3 fixed to the fuse element 2 and retaining the shape of the fuse element 2. Accordingly, the fuse element 2 can be manufactured by cutting the conductive wire rod into a predetermined length and then bending or crushing the cut wire rod. Thus, the fuse element can be manufactured with little material loss of the conductive wire rod. In particular, cutting work, crushing work, and bending work of the conductive wire rod can be performed by a single piece of equipment, so that the fuse element 2 can be manufactured at very low cost.

In addition, since the fuse element 2 is the wire rod, each connection terminal 2*a* has a small width, and the shape retaining member 3 to retain the shape of the fuse element 2 may have a small width and a simple shape. Thus, the fuse 1A can be formed to have the width W1 which is smaller than the conventional example. Hence, it is possible to downsize the fuse 1A.

The shape retaining member 3 is press-fitted into the fuse element 2 and is thereby fixed to the fuse element 2. Accordingly, the fuse 1A can easily be manufactured just by press-fitting the fuse element 2 into the shape retaining member 3.

The shape retaining member 3 includes the lock portions 3*b* to be locked by elastic deformation, and the fuse 1A is attached to the inside of the fuse container box 10 by use of the lock portions 3*b*. Thus, the fuse 1A can be attached reliably to the fuse container box 10 so as not to drop off merely by the insertion of the fuse 1A.

The fuses 1A are contained in the fuse container box 10 provided with the multiple cavities 14 partitioned by the partition walls 13. Each fuse 1A is small in size as described previously, so that the cavities 14 can be formed small as well. Thus, the fuse container box 10 can be reduced in size (reduced in height). In addition, since the fuse container box 10 has the multiple cavities 14 partitioned by the partition walls 13, the fuses thus reduced in size can be mounted densely while short circuits among the fuses are prevented. Because the fuse container box 10 can be reduced in size (reduced in height) in this manner, it is possible to reduce a thickness of the power source holder and to reduce a resin material for the vehicle junction block.

Meanwhile, in the fuse 1A, the width of the fuse element 2 can be changed by changing the bending positions of the wire rod. It is possible to reduce the thickness of the power source holder and to reduce the resin material for the vehicle junction block in this way as well.

Second Embodiment

Figure 9:
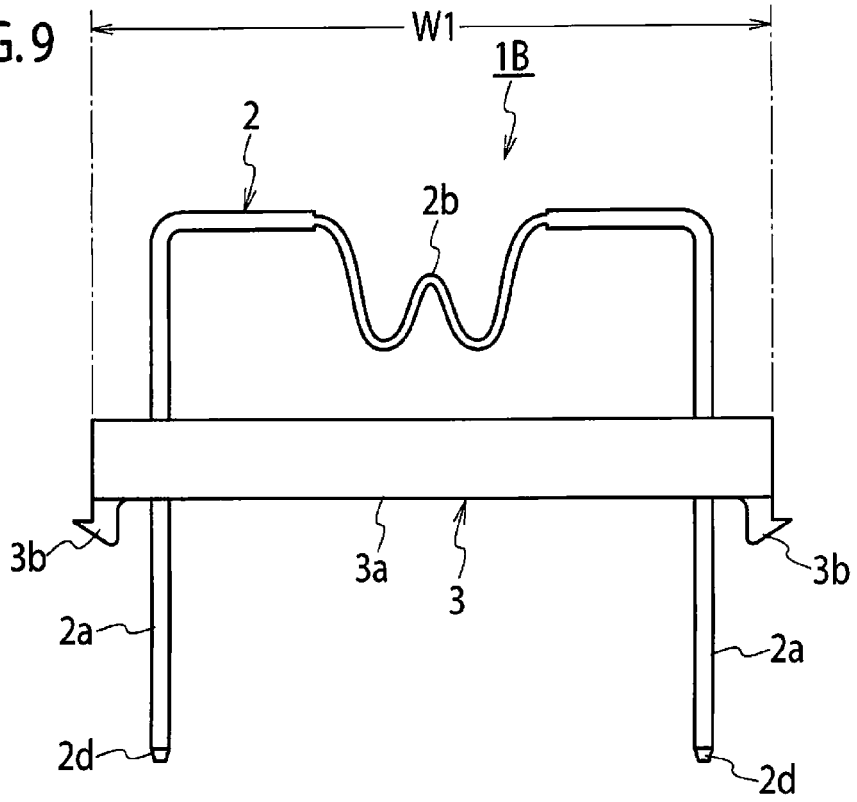
FIG. 9 is a front view of a fuse showing a second embodiment of the present invention.

FIG. 9 is a front view of a fuse 1B according to a second embodiment of the present invention.

As shown in FIG. 9, the fuse 1B of the second embodiment has a meltable portion 2*b* of the fuse element 2, which is formed into a corrugated shape. Such a curved shape of the meltable portion 2*b* is manufactured by bending work.

The rest of the configuration of the fuse 1B is the same as that of the first embodiment and duplicate description will therefore be omitted. Note that the same constituents in the relevant drawings are denoted by the same reference numerals for the purpose of clarification.

As described above, since the meltable portion 2*b* of the fuse element 2 is bent, it is possible to form the fuse 1B for a low current value, and to further reduce the width dimension of the fuse element 2.

Third Embodiment

Figure 10:
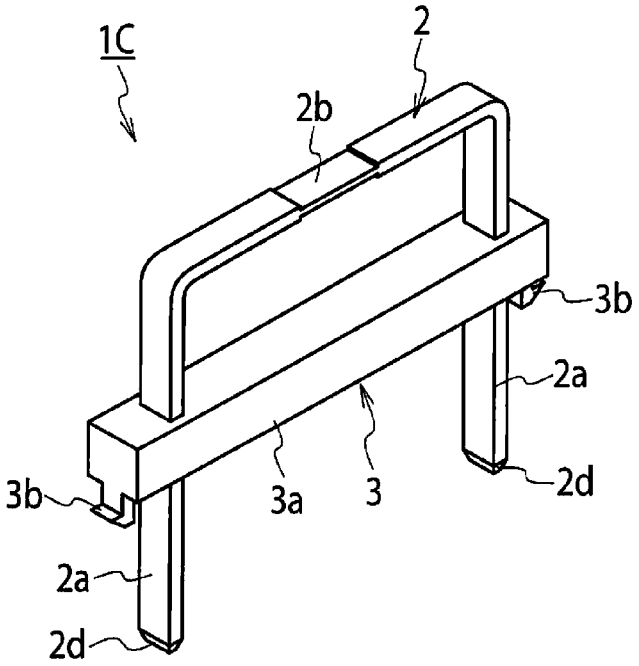
FIG. 10 is a perspective view of a fuse showing a third embodiment of the present invention.

FIG. 10 is a front view of a fuse 1C according to a third embodiment of the present invention.

As shown in FIG. 10, the fuse element 2 of the fuse 1C of the third embodiment is formed from a plate-shaped wire rod.

The rest of the configuration of the fuse 1C is the same as that of the first embodiment and duplicate description will therefore be omitted. Note that the same constituents in the relevant drawings are denoted by the same reference numerals for the purpose of clarification.

As described above, since the fuse element 2 has a plate shape, the fuse 1C has significant strength. Meanwhile, an opponent terminal may be formed into a shape of a tuning fork.

In the present invention, the fuse element 2 only needs to be able to undergo the bending work and the crushing work. Hence, the fuse element 2 may be formed of a wire rod having a cross-sectional shape other than the square shape or the plate shape.

INDUSTRIAL APPLICABILITY

According to the present invention, the fuse element can be manufactured by cutting the conductive wire rod into a predetermined length and then bending or crushing the cut wire rod. Thus, the fuse element can be manufactured with little material loss of the conductive wire rod. In addition, since the fuse element is the wire rod, each connection terminal has a small width and therefore the insulative retaining member to retain the shape of the fuse element may have a small width and a simple shape. Thus, the fuse can be reduced in size.

The invention claimed is:

1. A fuse comprising:

a conductive fuse element including a pair of connection terminals formed by bending two ends of a conductive wire rod parallel to each other, and a meltable portion provided between the pair of connection terminals and formed to have a smaller cross-sectional area than the remainder of the fuse element; and an insulative shape retaining member fixed to the pair of connection terminals of the fuse element and retaining a shape of the fuse element, each of the pair of connection terminals having a press-fit lock portion and a tapered portion, the press-fit lock portion having tiny projections protruding from a surface of the connection terminal, and the tapered portion being tapered forward to a tip end of the connection terminal, and the pair of connection terminals are press-fitted into and fixed to the shape retaining member at the press-fit lock portions, wherein the insulative shape retaining member includes:

a block portion in an elongated rectangular shape having a slightly larger dimension than a width of the fuse element, and a pair of lock portions that project outward from two ends on a bottom surface of the block portion;

in a first insertion position, the pair of connection terminals go into a terminal insertion hole of a fuse container box and the pair of lock portions of the shape retaining member hit peripheral edges of the terminal insertion hole; and in a second insertion position further inserted than the first insertion position, the pair of lock portions are elastically deformed and allowed to be inserted into and pass through the terminal insertion hole and the block portion of the shape retaining member hits a base plate of the fuse container box and the pair of lock portions are elastically restituted and locked with peripheral edges, on an opposite face side, of the terminal insertion hole.

2. The fuse according to claim 1, wherein the shape retaining member is attached to an inside of the fuse container box by use of the lock portion.

3. A fuse attachment structure that contains the fuse according to claim 1 in the fuse container box including a plurality of cavities partitioned by partition walls.

4. The fuse according to claim 1, wherein the press-fit lock portions are formed in intermediate positions of the respective connection terminals of the pair of connection terminals.

5. The fuse according to claim 1, wherein the fuse element formed from the conductive wire rod is made of a zinc alloy.

6. The fuse according to claim 1, wherein a cross-sectional area and a length of the meltable portion are adjusted depending on a value of an allowable current.

7. The fuse according to claim 1, wherein the pair of lock portions are elastically deformed by an external force from below in such a manner that the lock portions are held within the width dimension of the block portion.

8. The fuse according to claim 1, wherein the meltable portion of the fuse element is formed into a corrugated shape.

9. The fuse according to claim 8, wherein the meltable portion of the fuse element is formed into the corrugated shape by bending.

10. The fuse according to claim 1, wherein the conductive wire rod of the fuse element comprises a plate-shaped wire rod.

11. The fuse according to claim 1, wherein the conductive wire rod of the fuse element comprises a quadrangular cross-sectional shape.

* * * * *